US010155999B2

(12) United States Patent
Webster

(10) Patent No.: US 10,155,999 B2
(45) Date of Patent: Dec. 18, 2018

(54) HEAT TREAT PRODUCTION FIXTURE

(71) Applicant: Weatherford Technology Holdings, LLC, Houston, TX (US)

(72) Inventor: Oliver Webster, Aberdeenshire (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 516 days.

(21) Appl. No.: 14/777,359

(22) PCT Filed: Mar. 14, 2014

(86) PCT No.: PCT/GB2014/050797
§ 371 (c)(1),
(2) Date: Sep. 15, 2015

(87) PCT Pub. No.: WO2014/140618
PCT Pub. Date: Sep. 18, 2014

(65) Prior Publication Data

US 2016/0032415 A1 Feb. 4, 2016

(30) Foreign Application Priority Data

Mar. 15, 2013 (GB) ..... 1304771.7

(51) Int. Cl.
*C21D 1/30* (2006.01)
*F27D 5/00* (2006.01)
(Continued)

(52) U.S. Cl.
CPC ..... *C21D 1/30* (2013.01); *C21D 1/06* (2013.01); *C21D 1/74* (2013.01); *C21D 1/76* (2013.01);
(Continued)

(58) Field of Classification Search
None
See application file for complete search history.

(56) References Cited

U.S. PATENT DOCUMENTS 4,472,207 A * 9/1984 Kinoshita ..... B23P 15/00 148/610
5,026,436 A * 6/1991 Pohl ..... C21D 6/004 148/503
(Continued)

FOREIGN PATENT DOCUMENTS

DE 2449759 A1 * 8/1976 ..... C21D 6/004
RU 2065500 C1 8/1996
(Continued)

OTHER PUBLICATIONS

Mack et al.—2002—Corrosion 2002—The Effects of Cold Work and Strain Aging on the Hardness of Selected Grades of OCTG and on the SSC Resistance of API P-110—Results of Laboratory Experiments—Paper No. 02066 (Year: 2002).*
(Continued)

*Primary Examiner* — Deborah Yee
(74) *Attorney, Agent, or Firm* — Blank Rome LLP

(57) ABSTRACT

A method for manufacturing a metal structure (130) for use in a downhole assembly comprises plastically deforming at least a portion of the metal structure (130); and heating at least the deformed portion of the metal structure to a temperature below its critical and/or transformation temperature. An assembly for performing the method comprises a production fixture (370) configured to receive the metal structure (130), wherein the production fixture is adapted to undergo heating to a temperature below and/or up to the critical and/or transformation temperature of the metal structure. By heating at least the deformed portion of the metal structure to a temperature below its critical and/or transformation temperature, the metal structure may undergo stress relief, which may help prevent undesirable movement of deformed portion, e.g. collet fingers of a catching apparatus,
(Continued)

against the direction of deformation after impact(s) and/or shock(s) from moving objects, in use.

28 Claims, 5 Drawing Sheets

(51) Int. Cl.

| | |
|---|---|
| ***C21D 1/06*** | (2006.01) |
| ***C21D 7/00*** | (2006.01) |
| ***C21D 8/00*** | (2006.01) |
| ***C21D 1/74*** | (2006.01) |
| ***C21D 1/76*** | (2006.01) |
| ***C23C 8/24*** | (2006.01) |
| ***C23C 8/02*** | (2006.01) |
| ***C22C 38/00*** | (2006.01) |

(52) U.S. Cl.
CPC ..... *C21D 7/00* (2013.01); *C22C 38/00* (2013.01); *C23C 8/02* (2013.01); *C23C 8/24* (2013.01); *F27D 5/00* (2013.01); *C21D 2221/00* (2013.01)

(56) References Cited

U.S. PATENT DOCUMENTS

| | | | | |
|---|---|---|---|---|
| 5,211,768 | A * | 5/1993 | Preisser | C23C 8/26 148/212 |
| 5,462,121 | A | 10/1995 | Schmuck et al. | |
| 5,948,177 | A * | 9/1999 | Longwell | C21D 9/0068 148/217 |
| 6,425,444 | B1 | 7/2002 | Metcalfe et al. | |
| 2004/0055756 | A1 * | 3/2004 | Hillis | C21D 7/04 166/382 |
| 2008/0035328 | A1 | 2/2008 | Hill et al. | |
| 2012/0132426 | A1 | 2/2012 | Ku et al. | |
| 2013/0025868 | A1 * | 1/2013 | Smith | E21B 21/103 166/308.1 |
| 2013/0037273 | A1 | 2/2013 | Themig et al. | |
| 2013/0264123 | A1 * | 10/2013 | Altschuler | C21D 8/0236 175/325.2 |

FOREIGN PATENT DOCUMENTS

| | | | | |
|---|---|---|---|---|
| RU | 2111266 | C1 | 5/1998 | |
| RU | 2134726 | C1 | 8/1999 | |
| SU | 433223 | A | 6/1974 | |
| SU | 1452126 | A1 | 4/1990 | |
| WO | 2010/127457 | A1 | 11/2010 | |
| WO | WO2011/117601 | A2 * | 9/2011 | E21B 21/103 |

OTHER PUBLICATIONS

Machine-English translation of DE 2449759 A1, Brandis Helmut DR ING et al. , Aug. 5, 1976.*
English abstract of EP 1795622, Bode et al., Jun. 13, 2007.*
Int'l Search Report and Written Opinion in counterpart PCT Appl. PCT/GB2014/050797, dated Jun. 26, 2014, 7-pgs.

* cited by examiner

HEAT TREAT PRODUCTION FIXTURE

FIELD OF INVENTION

The present invention relates to a method for manufacturing a downhole system, such as downhole catching apparatus, and to an apparatus for carrying out said method.

BACKGROUND TO INVENTION

In the oil and gas industry many downhole operations rely on objects dropped from surface to be caught at some point along a downhole system to perform a desired function, such as mechanical actuation, flow diversion or the like. For example, International Applications Publication Nos. WO 2011/117601 and WO 2011/117602 each disclose downhole apparatus which catch objects for use in actuation of a downhole tool and flow diversion within the tool, for example for use in fracturing operations.

To catch an object, a catching apparatus typically defines a restriction along the associated flow path. However, it is undesirable to permanently create a restriction, as this restriction in the flowpath may cause detrimental effects to the operation of the wellbore. As such, a significant challenge in the industry has been to develop a catching apparatus which can establish the necessary restriction on a temporary basis.

A collet-type catching apparatus is known which includes a number of collet fingers each carrying a collet or seat member. The collet fingers are capable of being deflected radially to move the collet members between radially extended (outwards) and retracted (inwards) configurations. When radially retracted the collet members create a restriction and permit an object to be caught.

The catching apparatus may be installed in the downhole system with its collet members in a radially extended (outwards) configuration. In use, when actuation of a tool is required, the catching apparatus is actuated, e.g. by longitudinal movement relative to a sleeve, such that the collet members move into a retracted (inwards) configuration.

To provide the catching apparatus having collet members in a radially extended (outwards) configuration, the collet members are typically provided in a plastically deformed state. That is, during manufacture of the catching apparatus, the collets are plastically deformed outwardly to force them in the extended configuration, ready to be deployed in a downhole system.

In use, depending on the position of each catching device in a series of catching devices along the wellbore, many of the catching devices may be subjected to the passage of a large number of actuating objects, e.g. balls, before being deployed into their retracted (catching) configuration. The actuating objects typically travel at high velocity, carrying high momentum and energy. As they travel down the wellbore, the actuating objects will cause high impact collisions with the various parts of the downhole system. Therefore, the passage of each actuating object may cause high energy impacts or shocks on the extended collet members of the catching apparatus.

It has been observed that repeated shocks caused by the actuating objects on the collet members tend to cause the collet members to progressively move inwards, e.g. towards their retracted pre-deformed configuration. This is undesirable for several reasons. Firstly, if the collet members move inwards into the flow path of a fluid pumped into the wellbore, the collet members are directly exposed to the fluid flow path, and are therefore more likely to suffer from premature erosion. This is particularly true when the injected fluid is an abrasive fluid, for example a fracturing fluid comprising solid proppant particles. This may cause the collet members to lose their required sealing ability when actuated into their retracted configuration. Secondly, as the collet members move inwards into the flow path, the passage of each actuating object causes an increasingly higher impact on the collet fingers, thus exacerbating this adverse effect. Frictional collision of the collet members with the actuating objects may also cause further undesirable erosion, both of the collet members and of the actuating object.

SUMMARY OF INVENTION

According to a first aspect of the present invention there is provided a method for or of manufacturing a metal structure for use in a downhole assembly, the method comprising:

deforming at least a portion of the metal structure; and heating at least the deformed portion of the metal structure to a temperature below its critical and/or transformation temperature.

The metal structure may comprise a downhole apparatus.

The metal structure may comprise a catching apparatus. The catching apparatus may be configured to catch an object, e.g. an actuating object, such as a ball, dart, plug, tool or the like.

The catching apparatus may be for use in catching an object passing along any flow path, such as in a pipeline environment, downhole environment or the like.

The catching apparatus may be configured to catch an object travelling in a downhole environment, for example travelling through a tubular structure positioned within a wellbore, such as a tubing string, completion string, tool string, production string, injection string, fracturing string or the like. The catching apparatus may be configured to be located within a tubular structure. For example, the catching apparatus may be configured to be mounted within a housing of a downhole tool.

The catching apparatus may comprise a plurality of radially moveable seat members arranged circumferentially around a longitudinal axis.

The catching apparatus may define a catching sleeve. In such an arrangement the apparatus may be provided in the form of a sleeve.

The catching apparatus may be configured to function as a flow diverter when an object is caught.

The catching apparatus may be configured to function as an actuator when an object is caught. For example, the catching apparatus may be configured to actuate another component, structure, apparatus, tool or the like. For example, when an object is caught by the catching apparatus, the object may facilitate movement of the catching apparatus, for example by impact of the object against the apparatus, by a pressure differential established across the object/catching apparatus, or the like.

The catching apparatus may be provided in combination with a j-slot actuator arrangement.

The catching apparatus may be configured to function as a bore plug when an object is caught, for example to isolate a region within a tubing structure. Such an arrangement may facilitate pressure to be controlled, for example elevated, in a section of a tubing structure. Such an arrangement may facilitate pressure actuation of a further component, structure, apparatus, tool or the like, such as packers, slips, rupture disks and the like.

The catching apparatus may be configured to function as a flow restrictor when an object is caught. For example, the catching apparatus may be configured to function as a choke.

The catching apparatus may be configured for use within a fracturing system or operation. For example, the catching apparatus may be configured to actuate or open one or more fracturing valves to permit a fracturing fluid to be delivered into a surrounding formation. Alternatively, or additionally, the catching apparatus may be configured to function as a flow diverter when an object is caught to divert flow of fracturing fluid outwardly through opened ports and into a surrounding formation.

The seat members may be radially moveable to be radially extended and retracted relative to a central bore of the catching apparatus. That is, the seat members may be moveable radially inwardly to be retracted into the central bore to define a reduced effective inner diameter. The seat members may be moveable radially outwardly to be radially extended from the central bore to define an increased effective inner diameter. When the seat members are positioned radially inwardly and retracted into the central bore said members may be positioned into the path of an object passing through the catching apparatus. When in such a configuration the seat members may be engaged by an object. When the seat members are positioned radially outwardly and extended from the central bore said members may be outside the path of an object passing through the catching apparatus.

The catching apparatus may be configurable from a free configuration in which the seat members permit an object to pass the catching apparatus, to a catching configuration in which the seat members catch an object.

The catching apparatus may be reconfigured to or in its catching configuration by radially supporting the seat members in a radially inward position such that outward radial movement is prevented. In such a configuration an object passing through the catching apparatus may become seated against the radially supported seat members.

The catching apparatus may comprise a cylindrical portion at or near a first end of the catching apparatus.

The catching apparatus may comprise a plurality of radially moveable seat members arranged circumferentially around a longitudinal axis. The plurality of radially moveable seat members may be provided at or near a second end of the catching apparatus.

The catching apparatus may comprise a plurality of fingers which extend, e.g. in a tapering manner, between the cylindrical portion and the seat members.

The fingers and associated seat members may define a plurality of collet fingers.

At least a portion of the metal structure, e.g. the whole metal structure, may comprise steel, and/or any other suitable metal or metal alloy.

The method may comprise plastically deforming at least a portion of the metal structure.

Plastic deformation is understood to result from deformation of a metal beyond its elastic limit or yield point. Unlike elastic deformation, where a material will return to its original shape when the applied stress is removed, plastic deformation involves applying a level of stress beyond the yield point of the material, thereby causing permanent deformation.

In known methods of manufacturing a catching apparatus, plastic deformation forced on to the collet fingers induces some stress into the collet fingers. Without wishing to be bound by theory, it is believed that the inwards movement of the collet fingers resulting from the impacts with the actuating objects dropped into the downhole system, may be due to the energy provided by the shock of the actuating object onto the collet fingers. It is believed that the energy absorbed by the collet fingers may cause some of the residual stress to be relieved, and may cause the collet fingers to move against the direction of deformation and/or towards a pre-deformed configuration.

The present inventors have discovered that, by heating at least the deformed portion of a metal structure, e.g. a catching apparatus, the deformed portion, e.g. collet fingers, may undergo stress relief. This stress relief was observed to reduce the propensity of the deformed portion, e.g. collet fingers, to move against the direction of deformation after impact(s) and/or shock(s) from moving objects, in use.

The method may comprise providing or arranging the metal structure onto a production fixture. The method may comprise sliding the metal structure onto the production fixture. The production fixture may comprise a mandrel.

The production fixture may define a substantially cylindrical outer surface.

The production fixture may define a tapered profile, e.g. may define a substantially conical or frusto-conical outer surface.

The method may comprise forcing the metal structure onto the production fixture. The method may comprise deforming, e.g. plastically deforming, at least a portion of the metal structure by forcing the metal structure onto the production fixture.

The method may comprise deforming, e.g. plastically deforming, at least a portion of the metal structure by using a suitable tool, e.g. an articulated arm, pliers, lever, or the like.

The method may comprise securing the metal structure to the production fixture.

The method may comprise securing the metal structure to the production fixture by use of a fixing mechanism or arrangement such as screws, clamps, or the like.

The method may comprise securing the metal structure to the production fixture by use of a housing. The housing may be configured to contact and/or restrict movement of the metal structure, e.g. on the production fixture. In one embodiment, the shape of the housing may be substantially complementary to the shape of the metal structure, and/or the housing may be shaped to substantially contact at least a portion of an outer surface of the metal structure.

The method may comprise securing the housing to the production fixture, e.g. by use of a fixing mechanism or arrangement such as screws, clamps, or the like. By such provision, the metal structure may be securely positioned between the production fixture and the housing. The fixing mechanism or arrangement may form part of the housing and/or of the production fixture.

The production fixture, housing, and/or fixing mechanism or arrangement may be configured to be heated, e.g. may be made from a material, such as metal, suitable to withstand a temperature below and/or up to the critical and/or transformation temperature of the metal structure.

The method may comprise heating at least the deformed portion of the metal structure to a temperature below its critical and/or transformation temperature, e.g. below its lower critical and/or transformation temperature. The critical and/or transformation temperature may be defined as the temperature at which the metal may undergo molecular changes affecting its crystallinity, and/or the temperature at which the crystalline structure of the metal is modified. By heating at least the deformed portion of the metal structure to a temperature below its critical and/or transformation temperature, the metal structure may undergo stress relief, which may help prevent undesirable movement of the deformed portion, e.g. collet fingers, against the direction of deformation after impact(s) and/or shock(s) from moving objects, in use. Further, by maintaining temperature below the critical and/or transformation temperature, e.g. below the lower critical and/or transformation temperature, of the metal, the method may not significantly affect the crystallinity or structural integrity and/or properties of the material.

The method may comprise heating at least the deformed portion of the metal structure to a temperature in the range of 10-100° C., e.g. 20-90° C., e.g. 40-80° C., below its critical and/or transformation temperature. By such provision the heating temperature may be sufficiently high to relieve stress in a portion of interest, but sufficiently removed from the critical and/or transformation temperature, e.g. the lower critical and/or transformation temperature, to avoid affecting the crystallinity or structural integrity and/or properties of the material, e.g. at a molecular level. In one embodiment, the method may comprise heating at least the deformed portion of the metal structure to a temperature approximately 50° C. below its critical and/or transformation temperature, e.g. approximately 50° C. below its lower critical and/or transformation temperature.

The method may comprise heating at least the deformed portion of the metal structure to a temperature in the range of 450-580° C., e.g. 450-550° C., e.g. 500-550° C. Such a temperature range may be particularly useful when the metal structure comprises steel.

The method may comprise heating the metal structure at a predetermined temperature, e.g. in a pre-heated environment.

The method may comprise heating the metal structure at a predetermined rate.

The method may comprise the step of heating after the step of deforming.

The method may comprise heating and deforming simultaneously.

The method may comprise heating prior to deforming. In such instance, the method may comprise carrying out deforming while the temperature of at least the deformed portion remains within a range of temperature capable of relieving stress within the metal.

The method may comprise heating at least the deformed portion of the metal structure at a temperature below its critical and/or transformation temperature for a predetermined amount of time. The method may comprise heating the deformed portion for a period of time sufficient to remove a predetermined level of stress in the deformed portion of the metal structure, e.g. at least 25%, at least 50%, at least 75%, or at least 90%. The method may comprise heating the deformed portion at a predetermined temperature for e.g. at least 1 hour, at least 2 hours, at least 4 hours, at least 12 hours, at least 24 hours, at least 48 hours, at least 72 hours, or at least 96 hours.

The method may comprise heating the entire metal structure.

The method may comprise providing the metal structure in a heating apparatus, e.g. a furnace and/or an oven. The method may comprise providing the metal structure in position on the production fixture in the heating apparatus. The method may comprise providing the metal structure, the production fixture, and the housing in the heating apparatus.

The method may comprise cooling at least the deformed portion.

The method may comprise removing the metal structure from the heating apparatus, e.g. furnace and/or oven.

The method may comprise cooling at least the deformed portion at a predetermined temperature, e.g. at ambient temperature.

The method may comprise regulating and/or controlling cooling of at least the deformed portion so as to avoid and/or minimise stress resulting from temperature change. By such provision, the method may at least partially relieve stress in at least the deformed portion from the heating step, without incurring significant stress from the cooling step. This may be performed either in the furnace, or after removal of the metal structure from the furnace.

The method may comprise cooling the metal structure at a predetermined rate.

The method may comprise treating, e.g. surface treating, the metal structure.

The method may comprise coating at least a portion of the metal structure, e.g. with a hardening and/or lubricating coating. The coating may comprise a nitride coating comprising e.g., titanium nitride, silicon nitride, boron nitride, carbon nitride, and the like. The method may comprise coating at least a portion of the metal structure before, during, and/or after the heating step.

The method may comprise hardening at least a portion of the metal structure. The method may comprise forming a hardened layer of a material, e.g. at or near the surface of at least a portion of the metal structure. In one embodiment, the hardened layer may comprise a nitrogen or nitride compound. The method may comprise nitriding at least a portion of the metal structure.

The method may comprise gas nitriding at least a portion of the metal structure. The method may comprise contacting at least a portion of the metal structure with a nitrogen-containing gas, e.g. ammonia. The method may comprise injecting a nitrogen-containing gas, e.g. ammonia, in the heating apparatus, e.g. furnace and/or oven. Without wishing to be bound by theory, it is understood that, when a nitrogen-containing gas, e.g. ammonia, comes into contact with the heated portion of the metal structure, nitrogen reacts with and diffuses into the surface of the heated portion of the metal structure, to form a nitride layer. It is believed that, when the metal structure comprises steel, the nitrogen-containing gas, e.g. ammonia, may react with the heated portion of the metal structure to form nitride compounds such as iron nitrides. Depending on the type of metal used, e.g. the type of steel employed, the process may comprise forming other nitride compounds such as titanium nitrides, chromium nitrides, molybdenum nitrides and/or aluminium nitrides.

The method may comprise hardening, e.g. nitriding, the entire metal structure. The method may comprise providing the metal structure in a heating apparatus, e.g. a furnace and/or an oven, and injecting a nitrogen-containing gas, e.g. ammonia in the heating apparatus.

The method may comprise hardening, e.g. nitriding, a portion of the metal structure. In one embodiment, the method may comprise providing a portion of the metal structure in a heating apparatus, e.g. a furnace and/or an oven, and injecting a nitrogen-containing gas, e.g. ammonia in the heating apparatus. In another embodiment, the method may comprise protecting, e.g. by masking and/or by providing a protective coating on, a portion of the metal structure, providing the metal structure in a heating apparatus, e.g. a furnace and/or an oven, and injecting a nitrogen-containing gas, e.g. ammonia in the heating apparatus. By such provision, despite placing the entire metal structure in the heating apparatus, the method may comprise hardening only a selected portion of the metal apparatus.

The method may comprise simultaneously heating at least the deformed portion of the metal structure, and hardening at least a portion of the metal structure. The method may comprise heating at least the deformed portion of the metal structure to a temperature in the range of 10-100° C., e.g. 20-90° C., e.g. 40-80° C., below its critical and/or transformation temperature, and injecting a nitrogen-containing gas, e.g. ammonia, in the heating apparatus. By such provision, the method may allow simultaneously relieving stress from at least the deformed portion of the metal structure, and hardening at least a portion of the metal structure. Advantageously, this may allow reducing manufacturing costs by performing in a single step two separate treatments on the metal structure.

The deformed portion of the metal structure, and the portion of the metal structure to be hardened, may be the same or different. In one embodiment, the method may comprise heating and hardening the same portion of the metal structure, e.g. the entire metal structure. In another embodiment, the method may comprise heating the entire metal structure, and hardening only a portion of the metal structure, for example by protecting, e.g. by masking and/or by providing a protective coating on, a portion of the metal structure prior to placing the metal structure in the heating apparatus.

The method may comprise selecting time and/or temperature of the hardening step to provide one or more desired property of the hardened layer. In one embodiment, the hardening step may comprise hardening for a relatively short amount of time at a relatively high temperature. This may provide a relatively thin layer of hardened material, e.g. nitride. In another embodiment, the hardening step may comprise hardening for a relatively long amount of time. This may provide a relatively thick layer of hardened material.

The method may comprise providing a hardened and/or nitride layer having a thickness in the region of approximately 0.012"-0.020" (0.3-0.5 mm).

The method may comprise providing a hardened and/or nitride layer having a hardness of at least 550 HV, e.g. between 550 HV10 and 750 HV10. Hardness may be measured in accordance with ASTM E384.

According to a second aspect of the invention there is provided an assembly for manufacturing a metal structure for use in a downhole assembly, the assembly comprising a production fixture configured to receive the metal structure, wherein the production fixture is adapted to undergo heating to a temperature below the critical and/or transformation temperature of the metal structure.

The assembly may be configured to be placed in a heating apparatus, e.g. a furnace and/or an oven.

The production fixture may be configured to receive the metal structure in a sliding arrangement. The production fixture may comprise a mandrel.

The production fixture may define a substantially cylindrical outer surface.

The production fixture may define a tapered profile, e.g. may define a substantially conical or frusto-conical outer surface.

The assembly may comprise a housing adapted to secure the metal structure to the production fixture.

The housing may be configured to contact and/or restrict movement of the metal structure, e.g. on the production fixture. In one embodiment, the shape of the housing is substantially complementary to the shape of the metal structure, and/or the housing is shaped to substantially contact at least a portion of an outer surface of the metal structure.

The assembly may comprise a fixing arrangement such as screws, clamps, or the like, for securing the housing to the production fixture. By such provision, the metal structure may be securely positioned between the production fixture and the housing. The fixing arrangement may form part of the housing and/or of the production fixture.

The assembly, e.g. production fixture, housing, and/or fixing means, may be configured to be heated, e.g. may be made from a material, such as metal, suitable to withstand a temperature below and/or up to the critical and/or transformation temperature.

The features described above in relation to the method according to a first aspect of the present invention, can apply in respect of the assembly according to a second aspect of the present invention, and are therefore not repeated here for brevity.

According to a third aspect of the present invention there is provided a metal structure for use in a downhole assembly, obtainable by the method according to a first aspect of the present invention.

The metal structure may comprise a downhole apparatus.

The metal structure may comprise a catching apparatus. The catching apparatus may be configured to catch an object, e.g. an actuating object, such as a ball, dart, plug, tool or the like.

The catching apparatus may be for use in catching an object passing along any flow path, such as in a pipeline environment, downhole environment or the like.

The catching apparatus may be configured to catch an object travelling in a downhole environment, for example travelling through a tubular structure positioned within a wellbore, such as a tubing string, completion string, tool string, production string, injection string, fracturing string or the like. The catching apparatus may be configured to be located within a tubular structure. For example, the catching apparatus may be configured to be mounted within a housing of a downhole tool.

The catching apparatus may comprise a plurality of radially moveable seat members arranged circumferentially around a longitudinal axis.

The catching apparatus may define a catching sleeve. In such an arrangement the apparatus may be provided in the form of a sleeve.

The catching apparatus may be configured to function as a flow diverter when an object is caught.

The catching apparatus may be configured to function as an actuator when an object is caught. For example, the catching apparatus may be configured to actuate another component, structure, apparatus, tool or the like. For example, when an object is caught by the catching apparatus, the object may facilitate movement of the catching apparatus, for example by impact of the object against the apparatus, by a pressure differential established across the object/catching apparatus, or the like.

The catching apparatus may be provided in combination with a j-slot actuator arrangement.

The catching apparatus may be configured to function as a bore plug when an object is caught, for example to isolate a region within a tubing structure. Such an arrangement may facilitate pressure to be controlled, for example elevated, in a section of a tubing structure. Such an arrangement may facilitate pressure actuation of a further component, structure, apparatus, tool or the like, such as packers, slips, rupture disks and the like.

The catching apparatus may be configured to function as a flow restrictor when an object is caught. For example, the catching apparatus may be configured to function as a choke.

The catching apparatus may be configured for use within a fracturing system or operation. For example, the catching apparatus may be configured to actuate or open one or more fracturing valves to permit a fracturing fluid to be delivered into a surrounding formation. Alternatively, or additionally, the catching apparatus may be configured to function as a flow diverter when an object is caught to divert flow of fracturing fluid outwardly through opened ports and into a surrounding formation.

The seat members may be radially moveable to be radially extended and retracted relative to a central bore of the catching apparatus. That is, the seat members may be moveable radially inwardly to be retracted into the central bore to define a reduced effective inner diameter. The seat members may be moveable radially outwardly to be radially extended from the central bore to define an increased effective inner diameter. When the seat members are positioned radially inwardly and retracted into the central bore said members may be positioned into the path of an object passing through the catching apparatus. When in such a configuration the seat members may be engaged by an object. When the seat members are positioned radially outwardly and extended from the central bore said members may be outside the path of an object passing through the catching apparatus.

The catching apparatus may be configurable from a free configuration in which the seat members permit an object to pass the catching apparatus, to a catching configuration in which the seat members catch an object.

The catching apparatus may be reconfigured to or in its catching configuration by radially supporting the seat members in a radially inward position such that outward radial movement is prevented. In such a configuration an object passing through the catching apparatus may become seated against the radially supported seat members.

The catching apparatus may comprise a cylindrical portion at or near a first end of the catching apparatus.

The catching apparatus may comprise a plurality of radially moveable seat members arranged circumferentially around a longitudinal axis. The plurality of radially moveable seat members may be provided at or near a second end of the catching apparatus.

The catching apparatus may comprise a plurality of fingers which extend, e.g. in a tapering manner, between the cylindrical portion and the seat members.

The fingers and associated seat members may define a plurality of collet fingers.

At least a portion of the metal structure, e.g. the whole metal structure, may comprise steel, and/or any other suitable metal or metal alloy.

The metal structure may comprise a deformed portion, e.g. collet fingers in an extended configuration, substantially free of stress caused by plastic deformation of the deformed portion. The deformed portion, e.g. collet fingers in an extended configuration, may have a level of stress caused by plastic deformation of less than 75%, less than 50%, less then 25%, or less than 10% of the corresponding level of stress of a deformed portion not subjected to a heating step to a temperature below its critical and/or transformation temperature.

The features described above in relation to the method according to a first aspect or the assembly according to a second aspect of the present invention, can apply in respect of the metal structure according to a third aspect of the present invention, and are therefore not repeated here for brevity.

According to a fourth aspect of the present invention there is provided a metal structure for use in a downhole assembly, the metal structure comprising a deformed portion having undergone plastic deformation, wherein the deformed portion has been relieved of at least part of the stress caused by plastic deformation.

The metal structure may comprise a downhole apparatus.

The metal structure may comprise a catching apparatus. The catching apparatus may be configured to catch an object, e.g. an actuating object, such as a ball, dart, plug, tool or the like.

The catching apparatus may comprise a plurality of fingers and associated seat members which may define a plurality of collet fingers.

At least a portion of the metal structure, e.g. the whole metal structure, may comprise steel, and/or any other suitable metal or metal alloy.

The deformed portion, e.g. collet fingers in an extended configuration, may be substantially free of stress caused by plastic deformation of the deformed portion. The deformed portion, e.g. collet fingers in an extended configuration, may have a level of stress caused by plastic deformation of less than 75%, less than 50%, less then 25%, or less than 10% of the corresponding level of stress of a deformed portion which has not been subjected to stress relief.

The metal structure may comprise at least a hardened portion. The hardened portion may comprise a layer of a material, e.g. at or near the surface of the portion of the metal structure, such as a nitrogen or nitride compound. The hardened portion may comprise a nitrided, e.g. gas nitrided, portion and/or layer. In one embodiment, the entire metal structure may be hardened.

The hardened and/or nitride layer may have a thickness in the region of approximately 0.012"-0.020" (0.3-0.5 mm).

The hardened and/or nitride layer may have a hardness of at least 550 HV, e.g. between 550 HV10 and 750 HV10. Hardness may be measured in accordance with ASTM E384.

The features described above in relation to the method according to a first aspect, the assembly according to a second aspect, or the metal structure according to a third aspect of the present invention, can apply in respect of the metal structure according to a fourth aspect of the present invention, and are therefore not repeated here for brevity.

According to a fifth aspect of the present invention there is provided a method for or of manufacturing a metal structure for use in a downhole assembly, the method comprising:

deforming at least a portion of the metal structure on a production fixture; and hardening at least a portion of the metal structure while the metal structure is on the production fixture.

The method may comprise forming a hardened layer of a material, e.g. at or near the surface of at least a portion of the metal structure. In one embodiment, the hardened layer may comprise a nitrogen or nitride compound. The method may comprise nitriding at least a portion of the metal structure.

The production fixture may comprise a mandrel.

The method may comprise plastically deforming at least a portion of the metal structure.

The method may comprise heating at least the deformed portion of the metal structure to a temperature below its critical and/or transformation temperature. By such provision, the metal structure may undergo stress relief, which may help prevent undesirable movement of the deformed portion.

The features described above in relation to any other aspect of the present invention, can apply in respect of the method according to a fifth aspect of the present invention, and are therefore not repeated here for brevity.

BRIEF DESCRIPTION OF DRAWINGS

These and other aspects of the present invention will now be described, by way of example only, with reference to the accompanying drawings, in which.

DETAILED DESCRIPTION OF DRAWINGS

Figure 1:
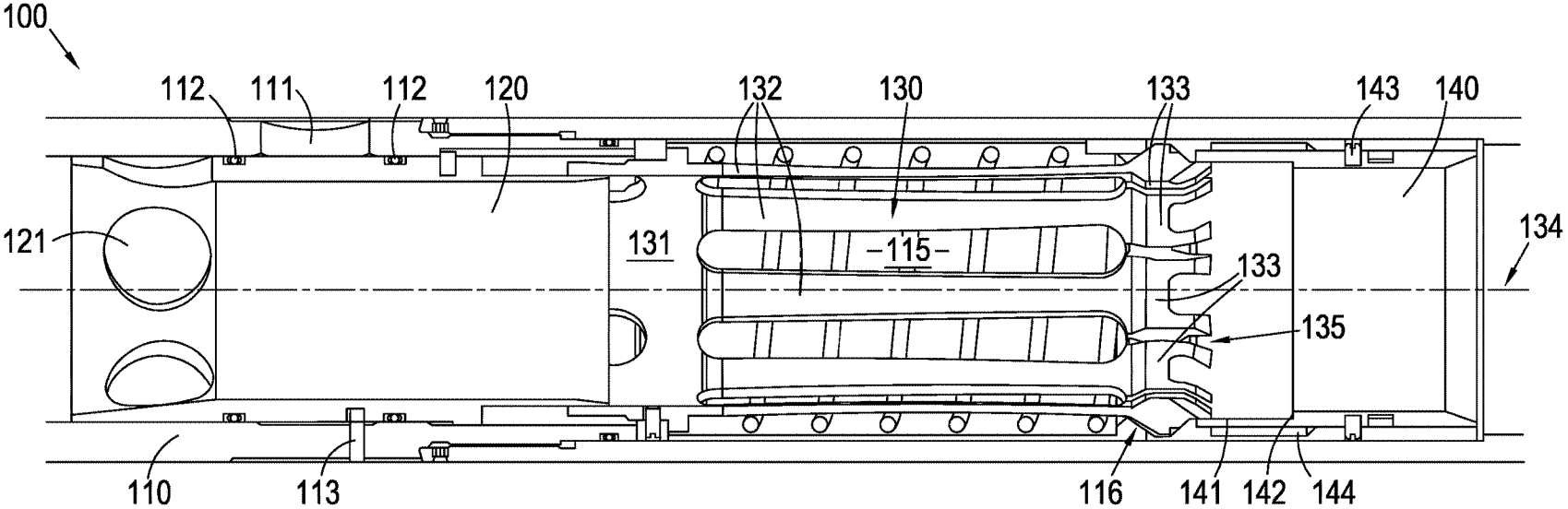
FIG. 1 a side view of a metal structure according to an embodiment of the present invention, in the form of a ball catching apparatus in a downhole assembly, in an extended or plastically deformed configuration.

A portion of a downhole tool, generally identified by reference number 100, is illustrated in FIG. 1. In the present embodiment the downhole tool 100 is for use in treating, for example fracturing, a subterranean formation. The tool 100 comprises a housing 110 which defines a plurality of ports 111 (only one visible on FIG. 1). A valve sleeve 120 is mounted within the housing 110 and is shown in a closed position in FIG. 1, in which the ports 111 are closed and sealed via o-rings 112. When in this initial closed position the valve sleeve 120 is pinned to the housing 110 via shear pin 113. The sleeve 120 comprises a plurality of sleeve ports 121.

A catching apparatus 130, according to an embodiment of the present invention, is mounted within the housing 110 on a downhole side of the valve sleeve 120. The catching apparatus 130 is provided, generally, in the form of a collet-type sleeve, and comprises a tubular body 131 and a plurality of collet fingers 132 which extend axially from the tubular body 131. Each finger 132 carries at a distal end thereof a respective seat member 133. The catching apparatus 130 defines a longitudinal axis 134, which is coincident with the longitudinal axis of the tool 100, and the fingers 132 and seat members 133 are circumferentially distributed around the axis 134. The fingers 132 are deflectable by bending in a longitudinal direction to permit the seat members 133 to be selectively moved radially into and out of a central bore or passage 115 defined by the catching apparatus 130.

In the configuration shown in FIG. 1, the seat members are positioned in an outwardly deformed or radially extended position, received within a recess 116 provided in the housing 110, and thus removed from the central bore 115. Accordingly, any object passing through the tool 100 will not be caught by the catching apparatus 130. For example, a passing object may continue past the tool 100 to perform some operation further downhole, for example within a deeper tool. In this respect, the catching apparatus 130 may be considered to be presented in a free configuration in FIG. 1.

An activator sleeve 140 is located downhole of the catching apparatus 130, wherein said sleeve 140 defines an activation surface 141 and a step profile 142. In the configuration shown in FIG. 1 the activator sleeve 140 is secured to the housing 110 via a number of shear screws 143, and covers an annular recess 144.

Figure 2A:
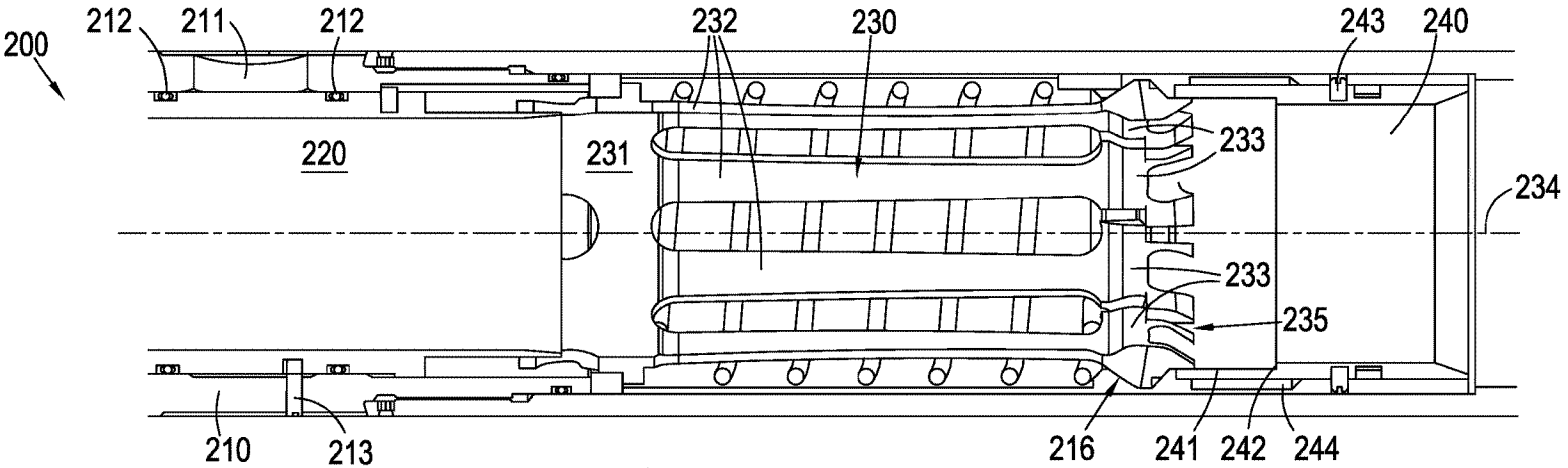
FIG. 2A a side view of a metal structure according to an alternative embodiment of the present invention, in the form of a ball catching apparatus in a downhole assembly, in an extended or plastically deformed configuration.

FIG. 2A shows a portion of a downhole tool 200, generally similar to the downhole tool 100 of FIG. 1, like part being denoted by like numerals, but incremented by '100'.

Whereas in FIG. 1, adjacent the seat members 133 of adjacent collet fingers 132 define substantially straight or longitudinally extending contact surfaces 135 when in an retracted or catching configuration, the seat members 233 of adjacent collet fingers 232 of the catching apparatus 230 of FIG. 2A define a contact surface 235 comprising circumferentially extending meshing or overlapping surfaces.

In other embodiments, the catching apparatus 130,230 may comprise contact surfaces having alternative profiles, such as waved, toothed, or the like.

Figure 2B:
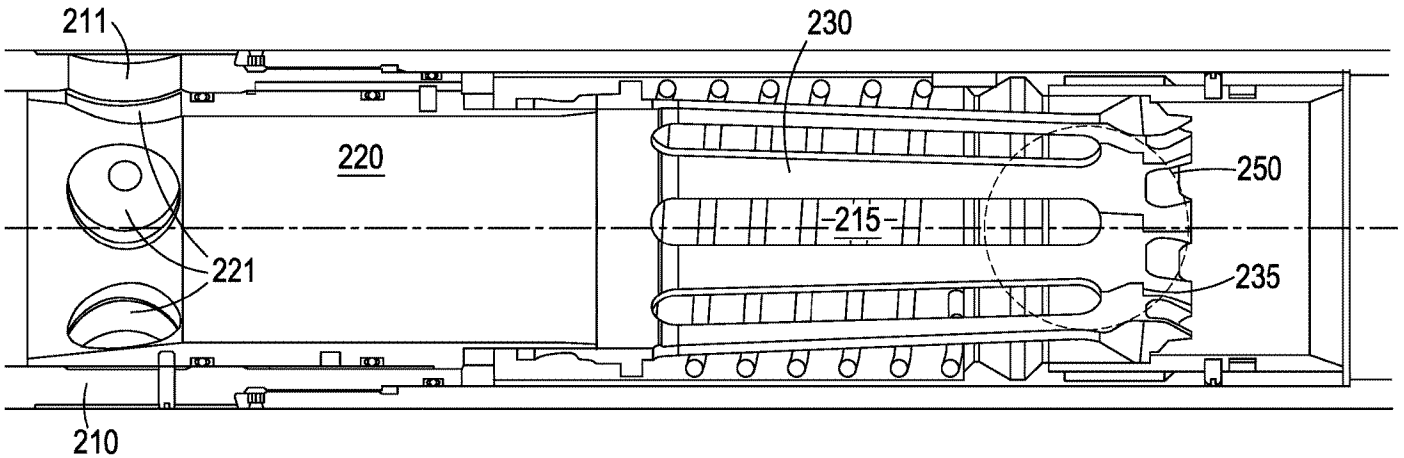
FIG. 2B the metal structure of FIG. 2A in a retracted or pre-deformation (catching) configuration.

The downhole tool 200 is shown in FIG. 2B in an initial activated configuration. Specifically, the shear screw 213 has been sheared and the valve sleeve 220 has been axially moved in a downhole direction to open the ports 211 and permit fluid communication outwardly from the tool 200. The valve sleeve 220 may be moved by any suitable actuator, such as via a piston. In some embodiments the valve sleeve may be moved or actuated by an indexing sleeve, such as a collet sleeve disclosed in WO 2011/117601 and/or WO 2011/117602.

During actuation the valve sleeve 220 acts upon the catching apparatus 230, causing the apparatus 230 to also move axially downhole within the housing 210, driving the seat members 233 out of the recess 216 and onto the activation surface 241 of the activator sleeve 240. Relative movement of the catching apparatus 230 and activator sleeve 240 is arrested upon engagement of the seat members 233 against the step profile 242. Thus, the seat members 233 are positioned radially inwardly in a retracted configuration, and into the central bore 215 of the apparatus 230. Such a configuration of the apparatus 230 may define a catching configuration. That is, any object, such as a ball 250 (shown in broken outline) of appropriate dimension passing through the tool 200 will engage and seat against the seat members 233, thus becoming caught.

In the exemplary embodiment shown, the ball 250 may function to block the tool 200 and establish a flow diversion such that substantially all fluid may be diverted outwardly through the ports 211, for example to fracture a surrounding formation. Further, in some embodiments the ball 250 may have previously operated a system, such as an indexing system, to initially move the valve sleeve 220 and/or catching apparatus 230.

Reference is now made to FIGS. 3A to 3D which provide perspective views of the catching apparatus 130 in sequential stages of manufacture.

Figure 3A:
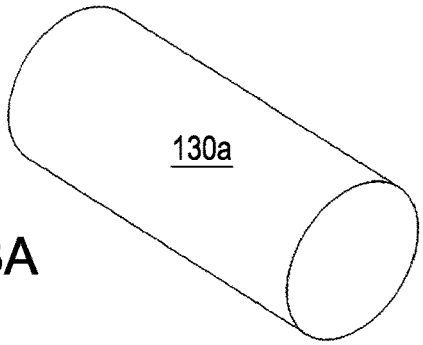
FIGS. 3A to 3D are perspective views of the metal structure of FIG. 1, shown in different stages of manufacture.
Figure 3B:
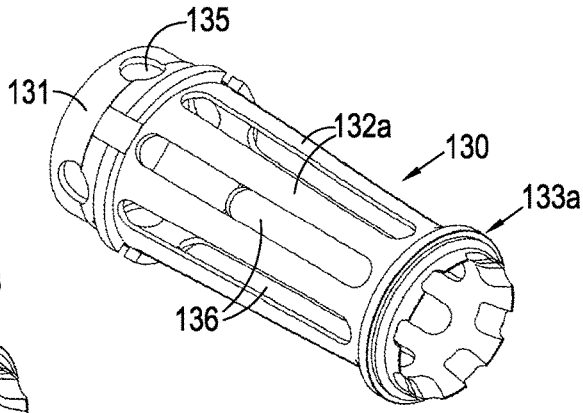

A cylindrical metal component 130*a* is provided as in FIG. 3A, and the catching apparatus 130 is initially machined as a complete component to the form illustrated in FIG. 3B. The catching apparatus 130 includes an uphole tubular portion 131 having a number of ports 135.

The seat members 133 are initially formed as a complete annular structure 133*a*, in the form that the seat members 133 adopt when positioned radially inwardly to catch a ball. The collet fingers 132 are provided as longitudinal ribs 132*a* which extend, at a slight inward taper, from the uphole tubular portion 131 to the complete annular structure 133*a*. The ribs 132*a* define slots 136 therebetween.

Figure 3C:
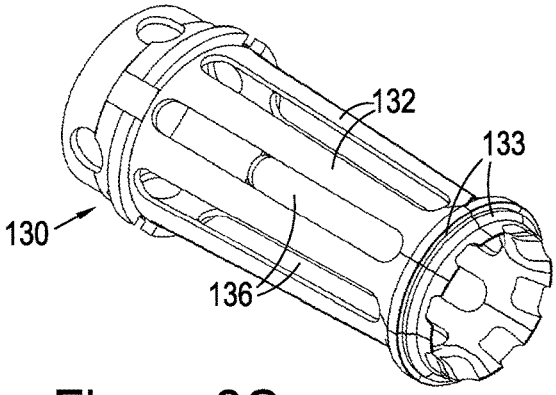

Once formed in this way the annular structure 133*a* is divided by wire cutting to form the individual seat members 133, as illustrated in FIG. 3C.

Figure 3D:
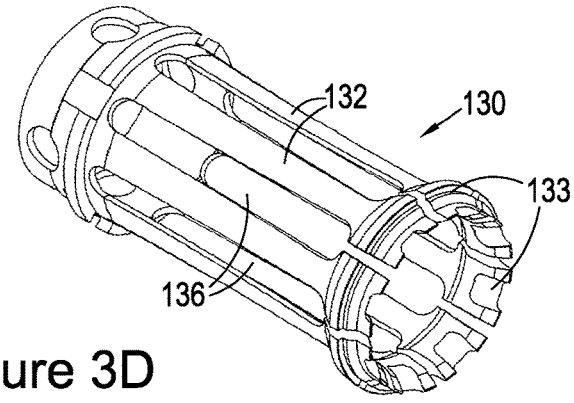

Following this division, the individual seat members 133 and associated collet fingers 132 are plastically deformed radially outwardly, to the form shown in FIG. 3D. This step is described below in more detail.

Figure 4:
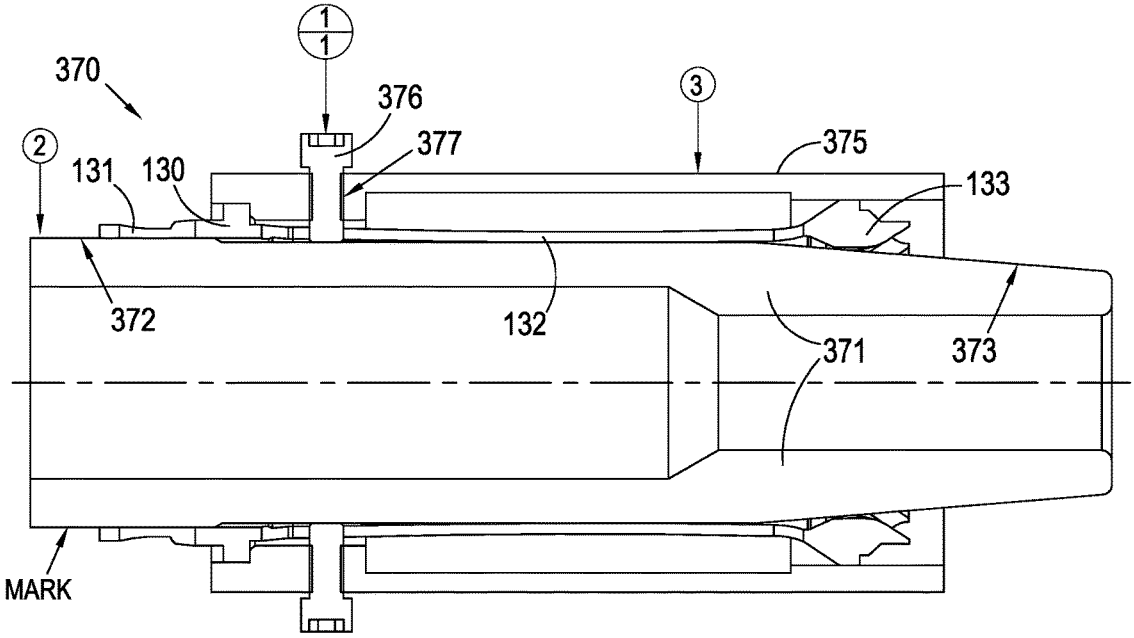
FIG. 4 is a cross-sectional view of a production fixture for manufacturing a metal structure, according to an embodiment of the present invention.

Referring now to FIG. 4, there is shown a production fixture, generally denoted 370, according to an embodiment of the present invention. In this embodiment, the production fixture 370 is configured to receive the catching apparatus 130 of FIG. 3C.

The production fixture 370 comprises a mandrel 371. In this embodiment the mandrel 371 comprises a hollow core. However, in other embodiments, the mandrel may have other constructions, e.g. may be solid.

The catching apparatus 130 is slid onto the mandrel 371. An upper portion of the catching apparatus 130, e.g. a portion comprising the tubular portion 131, is positioned near an upper portion 372 of the mandrel 371. The upper portion of the mandrel defines a substantially cylindrical outer surface. The mandrel 371 also comprises a tapered portion 373 which defines a substantially conical or frusto-conical outer surface. As the catching apparatus 130 is slid onto the mandrel 371, the seat members 133 engage the tapered portion 373 and are forced radially outwardly, thus deforming the collet fingers 132. If the stress on the fingers exceeds the elastic limit or yield point of the metal from which they are made, then plastic deformation occurs. Unlike elastic deformation, where a material will return to its original shape when the applied stress is removed, plastic deformation involves applying a level of stress beyond the yield point of the material, thereby causing permanent deformation.

As shown on FIG. 4, the production fixture 370 comprises a housing 375. The housing 375 is configured to engage with the catching apparatus 130 and to secure the catching apparatus 130 onto the mandrel 371. In this embodiment, the production fixture 370 comprises screws 376 to secure the catching apparatus 130 to the mandrel 371. The housing 375 comprises apertures 377 arranged to allow insertions of screws 376 through the housing 375. The screws are inserted though the slots 136 between fingers 132 of the catching apparatus 130. The mandrel 371 may also comprises apertures (not shown) for receiving the screws 376, thus securing the housing 375 to the mandrel 371, thereby ensuring secure engagement of the catching apparatus 130 between the mandrel 371 and the housing 375.

The mandrel 371, housing 375, and screws 376 are made of a metal suitable to be heated and to withstand a predetermined temperature up to the critical and/or transformation temperature of the catching apparatus 130.

According to a method of the present invention, at least a deformed portion of the catching apparatus 130 is heated to a temperature below its critical and/or transformation temperature in order to relieve stress within the deformed portion. In the present embodiment, the production fixture 370, including the catching apparatus 130 fixed to the production fixture 370, is heated.

Figure 5:
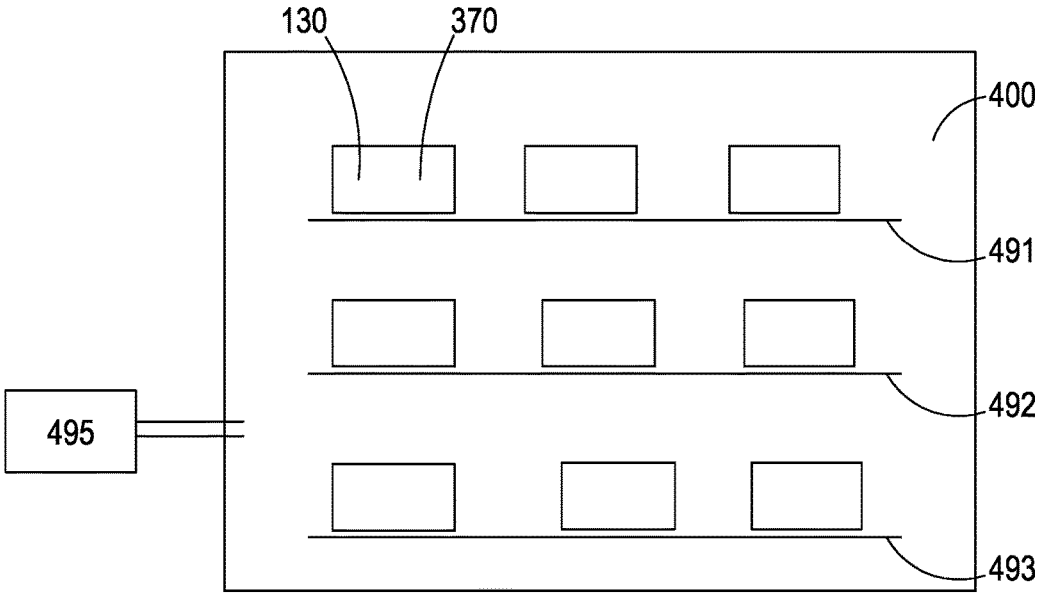
FIG. 5 is a schematic representation of a heating apparatus according to an embodiment of the present invention.

An embodiment of a suitable apparatus 400 for performing stress relief according to the present invention is shown in FIG. 5. The production fixture 370, including the catching apparatus 130 fixed to the production fixture 370, is placed in oven or furnace 400. In this embodiment, the furnace 400 has several shelves 491,492,493. This allows a plurality of catching apparatus 130 to be placed simultaneously in the furnace 400, for improved productivity and/or for improved consistency within a batch.

By heating the plastically deformed collet fingers 132 of the catching apparatus 130, to a temperature below its critical and/or transformation temperature, the metal structure undergoes stress relief. This, in turn, may help prevent undesirable subsequent movement of the plastically deformed collet fingers 132, against the direction of deformation, after impact(s) and/or shock(s) from moving objects, in use. Further, by maintaining temperature below the critical and/or transformation temperature of the metal, the method of the present invention does not significantly affect the crystallinity or structural integrity and/or properties of the metal.

In this embodiment, the catching apparatus 130 is placed in a furnace 400 preheated at a predetermined temperature. In other embodiments, the catching apparatus may be placed in an unheated furnace, and the temperature of the furnace 400 may then be raised to a predetermined temperature.

In this embodiment, the catching apparatus 130 is heated to a temperature in the range of 10-100° C., e.g. 20-90° C., e.g. 40-80° C., below its critical and/or transformation temperature. In one embodiment, the method comprises heating the catching apparatus 130 to a temperature approximately 50° C. below its critical and/or transformation temperature. In this embodiment, the catching apparatus 130 is made of steel. The catching apparatus 130 is heated to a temperature of 450-550° C. for approximately 96 hours.

It will be appreciated that the critical and/or transformation temperature depends on the particular type of metal or metal alloy from which the catching apparatus 130 is made, and the skilled person would determine the desired heating temperature based on the known critical and/or transformation temperature for a particular metal or metal alloy.

The catching apparatus 130 is left in the furnace 400 at the predetermined temperature below its critical and/or transformation temperature, for a predetermined amount of time, e.g. for a period of time sufficient to remove a predetermined level of stress in the catching apparatus 130. In one embodiment, the catching apparatus 130 is left in the furnace 400 at the predetermined temperature for a period of time sufficient to remove, e.g. at least 25%, at least 50%, at least 75%, or at least 90% of the stress caused by plastic deformation in the collet fingers 132. In this embodiment, the method comprises heating the catching apparatus 130 at the predetermined temperature for approximately 96 hours.

In this embodiment, the method comprises hardening the catching apparatus 130. The method comprises injecting a nitrogen-containing gas, in this embodiment ammonia, in the furnace 400 via a gas injector 495. Without wishing to be bound by theory, it is understood that, when a nitrogen-containing gas, e.g. ammonia, comes into contact with the heated catching apparatus 130, nitrogen reacts with and diffuses into the surface of the metal apparatus, to form a nitride layer. By nitriding the catching apparatus 130 while heating the catching apparatus 130 to a temperature of approximately 50° C. below its critical and/or transformation temperature, e.g. to a temperature of 450-550° C., for approximately 96 hours, the method allows simultaneously relieving stress from at least the deformed portion of the steel catching apparatus 130, and hardening the surface of the catching apparatus 130. The method provides a nitride layer having a thickness in the region of approximately 0.012"-0.020" (0.3-0.5 mm), and a hardness in the region of 550 HV10 and 750 HV10, as measured in accordance with ASTM E384.

The catching apparatus 130 is then cooled.

In one embodiment, the catching apparatus 130 is removed from the furnace 400, and left to cool at a predetermined temperature, e.g. at ambient temperature.

In another embodiment, the catching apparatus 130 is cooled in a controlled manner by lowering the temperature of the furnace following a predetermined temperature profile, e.g. by cooling the metal structure at a predetermined rate.

The invention claimed is:

1. A method for manufacturing a metallic catching apparatus for use in catching an object in a downhole assembly, the method comprising:

forming a cylindrical portion at or near a first end of the catching apparatus;

forming a plurality of radially moveable seat members arranged circumferentially around a longitudinal axis, the seat members being provided at or near a second end of the catching apparatus;

forming a plurality of fingers which extend between the cylindrical portion and the seat members, wherein the fingers and associated seat members define a plurality of collet fingers;

plastically deforming at least a portion of the collet fingers; and heating at least the deformed portion of the collet fingers to a temperature below a critical and/or transformation temperature of the material forming the collet fingers.

2. The method according to claim 1, comprising providing or arranging the catching apparatus on a production fixture.

3. The method according to claim 2, wherein the production fixture comprises a mandrel.

4. The method according to claim 2, wherein the production fixture defines a cylindrical outer surface, and/or a tapered profile outer surface.

5. The method according to claim 2, wherein plastically deforming at least the portion of the collet fingers comprises forcing the catching apparatus onto the production fixture.

6. The method according to claim 2, comprising securing and/or fixing the catching apparatus to the production fixture.

7. The method according to claim 6, wherein securing and/or fixing the catching apparatus to the production fixture comprises use of a housing configured to contact at least a portion of an outer surface of the catching apparatus.

8. The method according to claim 7, comprising securing and/or fixing the housing to the production fixture.

9. The method according to claim 1, wherein heating comprises heating at least the deformed portion of the collet fingers to the temperature in the range of at least one of:

10-100° C. below the critical and/or transformation temperature;

20-90° C. below the critical and/or transformation temperature;

40-80° C. below the critical and/or transformation temperature; and

50° C. below the critical and/or transformation temperature.

10. The method according to claim 1, wherein heating comprises heating at least the deformed portion of the collet fingers to the temperature in the range of 450–550° C.

11. The method according to claim 1, wherein the catching apparatus comprises steel.

12. The method according to claim 1, wherein heating comprises heating at least the deformed portion of the collet fingers for a period of time sufficient to remove a predetermined level of stress in said deformed portion.

13. The method according to claim 1, wherein heating comprises heating at least the deformed portion of the collet fingers at a predetermined level of the temperature for at least one of:

at least 1 hour;

at least 2 hours;

at least 4 hours; and at least 24 hours.

14. The method according to claim 1, wherein heating comprises heating the entire catching apparatus.

15. The method according to claim 14, comprising providing or arranging the catching apparatus on a production fixture and providing the catching apparatus in position on the production fixture in a heating apparatus.

16. The method according to claim 15, comprising providing the catching apparatus, the production fixture, and the housing in the heating apparatus.

17. The method according to claim 1, comprising cooling at least the deformed portion of the collet fingers.

18. The method according to claim 17, wherein cooling comprises cooling at least the deformed portion of the collet fingers at a predetermined temperature.

19. The method according to claim 17, wherein cooling comprises regulating and/or controlling the cooling of at least the deformed portion of the collect fingers so as to avoid and/or minimize stress resulting from temperature change.

20. The method according to claim 1, comprising hardening at least a portion of the catching apparatus.

21. The method according to claim 1, comprising gas nitriding at least a portion of the catching apparatus.

22. The method according to claim 20, wherein the hardened and/or nitride layer has a thickness in the region of approximately 0.012"-0.020" (0.3-0.5 mm).

23. The method according to claim 20, wherein the hardened and/or nitride layer has a hardness of at least one of:

550 HV; and between 550 HV10 and 750 HV10.

24. The method according to claim 21, comprising injecting ammonia gas into a heating apparatus.

25. The method according to claim 1, wherein heating comprises simultaneously heating at least the deformed portion of the collet fingers, to the temperature below the critical and/or transformation temperature, and hardening at least a portion of the catching apparatus.

26. An assembly for manufacturing a metallic catching apparatus according to the method of claim 1 for use in a downhole assembly.

27. A metallic catching apparatus manufactured according to the method of claim 1 for use in a downhole assembly.

28. The method according to claim 1, comprising plastically deforming each collet finger from an initial retracted position into an extended position, such that, in use, the collet fingers are moveable to their retracted position to catch the object.

* * * * *